US009795936B2

(12) United States Patent
Yasuda et al.

(10) Patent No.: US 9,795,936 B2
(45) Date of Patent: Oct. 24, 2017

(54) FLUID MIXING ELEMENT

(71) Applicant: HORIBA STEC, Co., Ltd., Kyoto-shi, Kyoto (JP)

(72) Inventors: Tadahiro Yasuda, Kyoto (JP); Shigeyuki Hayashi, Kyoto (JP)

(73) Assignee: HORIBA STEC, Co., Ltd., Kyoto-shi, Kyoto (JP)

( * ) Notice: Subject to any disclaimer, the term of this patent is extended or adjusted under 35 U.S.C. 154(b) by 0 days.

(21) Appl. No.: 14/141,336

(22) Filed: Dec. 26, 2013

(65) Prior Publication Data

US 2014/0182726 A1 Jul. 3, 2014

(30) Foreign Application Priority Data

Dec. 28, 2012 (JP) ..... 2012-287129

(51) Int. Cl.

| | |
|---|---|
| ***B01L 5/04*** | (2006.01) |
| ***B01F 5/00*** | (2006.01) |
| ***B01F 13/10*** | (2006.01) |
| ***B01F 3/02*** | (2006.01) |
| *B01F 5/04* | (2006.01) |

(52) U.S. Cl.

CPC ..... *B01F 5/0082* (2013.01); *B01F 3/02* (2013.01); *B01F 13/1016* (2013.01); *B01F 5/04* (2013.01); *B01F 5/045* (2013.01); *B01F 2005/0088* (2013.01); *B01F 2005/0091* (2013.01); *Y10T 137/2224* (2015.04)

(58) Field of Classification Search

CPC ..... B01F 5/04; B01F 2005/0088; B01F 2005/0091

USPC ..... 137/896; 366/182.1

See application file for complete search history.

(56) References Cited

U.S. PATENT DOCUMENTS 4,053,142 A * 10/1977 Johannes ..... B01F 5/0068 366/165.1

4,150,817 A * 4/1979 Regelin et al. ..... 266/139

(Continued)

FOREIGN PATENT DOCUMENTS

| | | |
|---|---|---|
| CA | 2705055 A1 | 11/2011 |
| GB | 1603090 A | 11/1981 |

(Continued)

OTHER PUBLICATIONS

Japanese Patent Office, Office Action Issued in Patent Application No. 2012-287129, Jun. 16, 2015, 3 pages.

(Continued)

*Primary Examiner* — Michael R Reid
*Assistant Examiner* — Christopher Ballman
(74) *Attorney, Agent, or Firm* — Alleman Hall Creasman & Tuttle LLP

(57) ABSTRACT

The fluid mixing element in accordance with this invention forms a first internal flow channel whose starting end opens on an end surface of one end part and whose terminal end opens on an end surface of the other end part and a second internal flow channel whose starting end opens on a side peripheral surface of a middle part and whose terminal end opens on an end surface of the other end part. It is possible for the fluid mixing element to securely mix a first fluid flowing in a main flow channel with a second fluid flowing in a sub-flow channel by the use of a pipe with a short length with a simple arrangement.

3 Claims, 16 Drawing Sheets

(56) References Cited

U.S. PATENT DOCUMENTS 4,344,752 A * 8/1982 Gallagher, Jr. ..... 431/354
4,483,805 A * 11/1984 Glindsjo ..... 261/78.2
4,753,535 A * 6/1988 King ..... B01F 5/0451 366/174.1
4,993,495 A * 2/1991 Burchert ..... B01F 5/0403 169/14
5,492,404 A * 2/1996 Smith ..... B01F 5/0057 366/165.1
5,863,128 A * 1/1999 Mazzei ..... 366/163.2
6,116,861 A * 9/2000 Hogan et al. ..... 417/313
6,245,278 B1 * 6/2001 Lausenhammer ..... B29C 45/27 264/328.1
6,279,611 B2 * 8/2001 Uematsu et al. ..... 137/888
6,347,883 B1 * 2/2002 Ekholm ..... B01F 3/0446 366/160.1
8,316,875 B2 * 11/2012 Erickson et al. ..... 137/111
2004/0089078 A1 * 5/2004 Gehner et al. ..... 73/863
2004/0100861 A1 * 5/2004 Vanden Bussche ..... B01F 5/04 366/165.1
2006/0257807 A1 * 11/2006 Hicks ..... F23R 3/286 431/354
2008/0087348 A1 * 4/2008 Gillis et al. ..... 137/896
2009/0199919 A1 * 8/2009 Durant et al. ..... 137/896
2011/0087056 A1 * 4/2011 Tirtowidjojo ..... B01J 19/0026 570/175
2012/0222649 A1 9/2012 Kudoh

FOREIGN PATENT DOCUMENTS

JP 47013657 Y1 5/1972
JP 56129820 U 10/1981
JP 03041846 U 4/1991
JP 08-279466 A 10/1996
JP 2003144879 A 5/2003
JP 2007237161 A 9/2007
JP 2008074702 A 4/2008
WO 2011044522 A2 4/2011
WO 2011052416 A1 5/2011
WO WO 2012130254 A1 * 10/2012 ..... 137/896

OTHER PUBLICATIONS

Japan Patent Office, Office Action Issued in Application No. 2016-092245, Feb. 14, 2017, 3 pages.

* cited by examiner

FLUID MIXING ELEMENT

FIELD OF THE ART

This invention relates to a fluid mixing element that mixes a plurality of precursory gasses used for, for example, a semiconductor manufacturing process.

BACKGROUND ART

Conventionally, in a case of mixing and supplying a plurality of precursory gasses to, for example, a semiconductor process chamber, a plurality of sub-flow channels are connected to the upstream side of the main flow channel and the main flow channel is extended by several meters and connected to the process chamber. With this arrangement, the precursory gasses that flow from each flow channel are practically mixed in the main flow channel and then supplied to the process chamber.

However, if a pipe length of the main flow channel is shortened in an effort to downsize, the above-mentioned arrangement might fail to sufficiently mix the precursory gases.

For example, as shown in FIG. 16, in a case that a first fluid flows in a state of near laminar flow, the flow rate is the fastest at a center and becomes slower approaching the periphery so that the flow rate becomes almost zero near a pipe wall. Then, if a flow rate of a second fluid flowing in the pipe is small compared to the flow rate of the first fluid, the second fluid just flows slowly in proximity to the pipe wall around the first fluid so that a long period of time and a long pipe length are required for the second fluid to be mixed with the first fluid.

Then as shown in patent document 1, a helical plate is welded downstream of a portion where the sub-flow channel is connected to the main flow channel. In accordance with this arrangement, mixing of the first fluid and the second fluid can be promoted due to a stirring effect by the helical plate so that the pipe length can be shortened.

However, it takes time and costs money to join the helical plate to the pipe. In addition, for example, as shown in FIG. 15, in a case that the first fluid in the main flow channel flows in a state of a turbulent flow, since the first fluid flows back in the sub-flow channel due to a pressure difference and the second fluid has difficulty flowing into the main flow channel, the helical plate might fail to produce the effect sufficiently.

PRIOR ART DOCUMENTS

Patent Documents

Patent document 1: Japanese Unexamined Patent Application Publication No. 8-279466

DISCLOSURE OF THE INVENTION

Problems to be Solved by the Invention

The present claimed invention intends to solve all of the above problems and a main object of this invention is to provide a fluid mixing element that can ensure mixture of a second fluid flowing in a sub-flow channel with a first fluid flowing in a main flow channel by the use of a pipe with a short length.

Means to Solve the Problems

More specifically, a fluid mixing element in accordance with this invention is a fluid mixing element that is arranged in a pipe member where a sub-flow channel where a second fluid flows is connected with a main flow channel where a first fluid flows so as to mix the first fluid and the second fluid, and is characterized by a first internal flow channel whose starting end opens on an end surface of one end part of the fluid mixing element and whose terminal end opens on an end surface of the other end part of the fluid mixing element and a second internal flow channel whose starting end opens in a side peripheral surface of a middle part between the above-mentioned one end part and the other end part and whose terminal end opens in the end surface of the other end part are formed, and the above-mentioned one end part fits into the main flow channel at an upstream side of a portion where the main flow channel is connected with the sub-flow channel and the above-mentioned other end part fits into the main flow channel at a downstream side of the portion where the main flow channel is connected with the sub-flow channel so that a terminal end opening of the second internal flow channel is arranged to face a starting end opening of the sub-flow channel.

In accordance with this arrangement, the first fluid that flows from the main flow channel passes through the first internal flow channel and flows into the main flow channel located on the downstream side of the fluid mixing element, and the second fluid that flows from the sub-flow channel passes through the second internal flow channel and flows into the main flow channel located on the downstream side of the fluid mixing element. Then, since both of the first fluid and the second fluid flow out to the downstream side of the main flow channel from the end surface of the other end part of the fluid mixing element, it is possible to certainly mix the first fluid and the second fluid with a short pipe without being at a standstill near the wall of the pipe of the main flow channel and without disturbing the second flow channel from flowing into the main flow channel due to the first fluid entering the sub-flow channel.

In addition, since the fluid mixing element can be mounted just by sliding the fluid mixing element into the main flow channel, it is easy to install the fluid mixing element and to mount the fluid mixing element on an existing pipe with ease.

In order to further promote mixing of the first fluid and the second fluid, it can be represented by a fluid mixing element, wherein an elongate direction of the terminal end part of at least one of the first internal flow channel and the second internal flow channel is extended in a diagonal direction to an axial direction of the main flow channel. In accordance with this arrangement, since a component in the radial direction is contained in a travelling direction of the fluid just after the fluid flows out from the fluid mixing element, a flow near the center of the main flow channel mixes with a flow near an inner side surface so that mixing of each fluid is furthermore promoted. Similar to a twisted direction, the diagonal direction may contain a component in the tangential direction of the circumference in addition to the component in the radial direction.

Another concrete embodiment to promote further mixing the fluids represented is that a plurality of terminal end parts of at least one of the first internal flow channel and the second internal flow channel are arranged. Especially, if a plurality of terminal end parts of the first internal flow channel and a plurality of terminal end parts of the second internal flow channel are arranged, and openings of the plurality of terminal end parts of the first internal flow channel and openings of the plurality of terminal end parts of the second internal flow channel are alternately arranged on an end surface of the other end part of the fluid mixing element, since each fluid is divided into multiple openings in advance and then mixed with each other, it becomes possible to mix the fluids in a short period of time by the use of a pipe with a short length.

In order to make it possible to insert and mount the fluid mixing element on the main flow channel without adjusting an angle at which the fluid mixing element is inserted around an axis with ease, it is preferable that the second internal flow channel comprises a circumferentially surrounding groove that is arranged to surround a side peripheral surface of the middle part and one or more through bores each with a starting end that opens in a flow channel of the circumferentially surrounding groove and a terminal end that opens in the end surface of the above-mentioned other end part.

Effect of the Invention

In accordance with this invention having the above-mentioned arrangement, since both of the first fluid and the second fluid flow out toward the downstream side of the main flow channel from an end surface of the other end part of the fluid mixing element, it is possible to certainly mix the first fluid and the second fluid with a short pipe without being at a standstill near the wall of the pipe of the main flow channel and without disturbing the second flow channel from flowing into the main flow channel due to the first fluid entering the sub-flow channel.

In addition, since the fluid mixing element can be mounted just by sliding the fluid mixing element into the main flow channel, it is easy to install the fluid mixing element and to mount the fluid mixing element on an existing pipe with ease.

BEST MODES OF EMBODYING THE INVENTION

One embodiment of this invention will be explained with reference to the drawings.

First Embodiment

Figure 1:
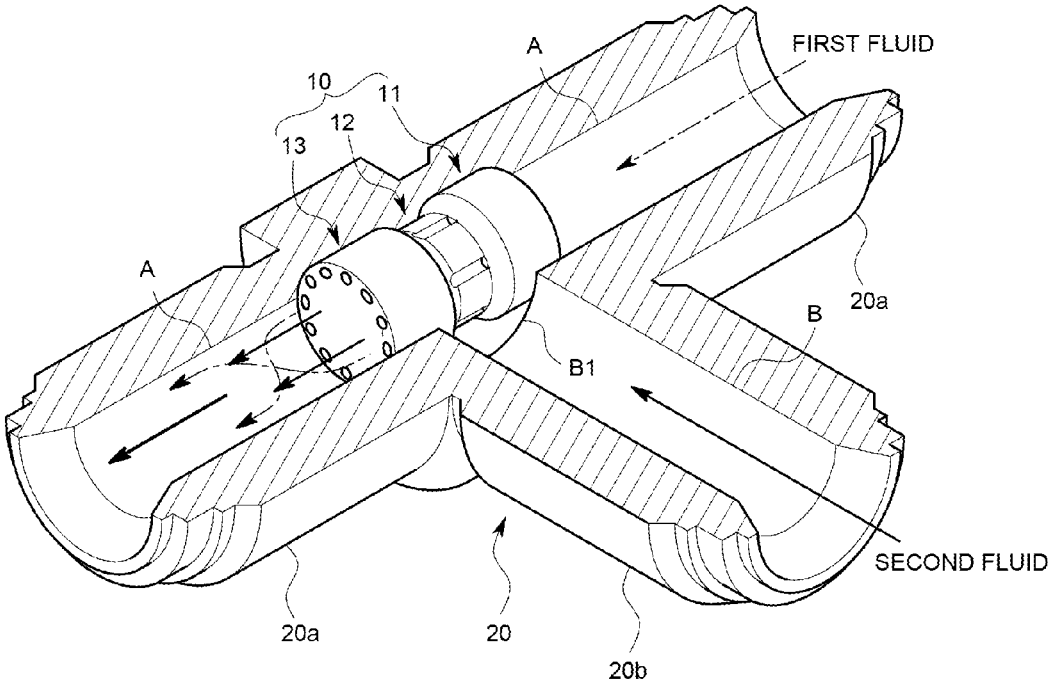
FIG. 1 is a cross-sectional perspective view showing a state wherein a fluid mixing element in accordance with a first embodiment of this invention is mounted on a pipe structure.
Figure 2:
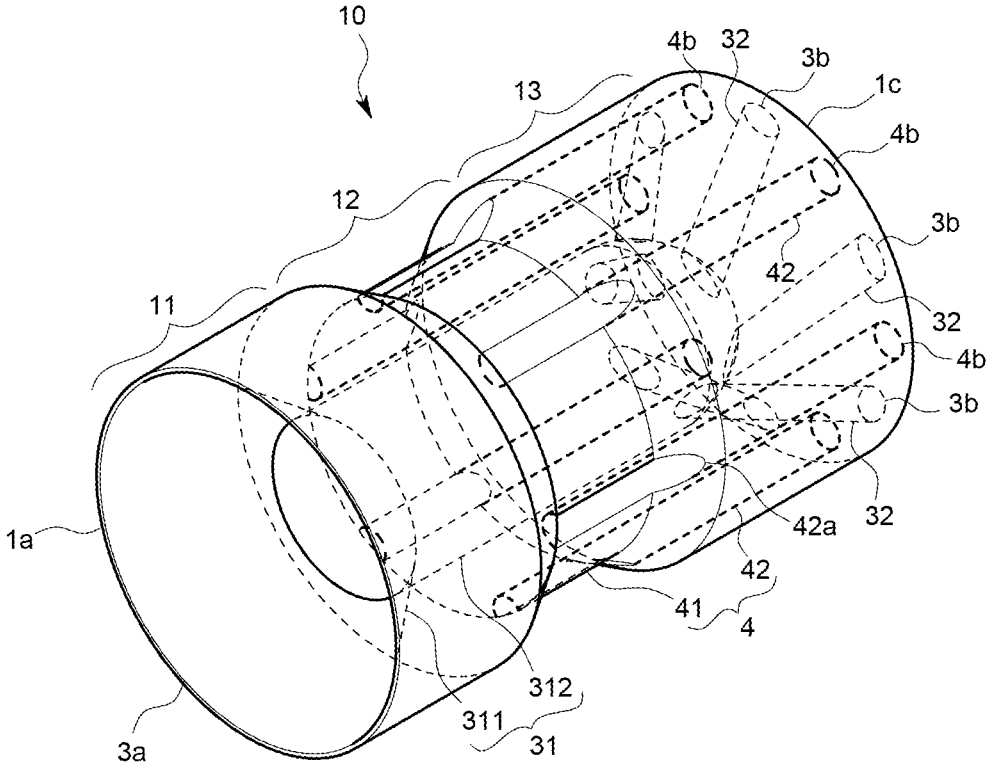
FIG. 2 is a perspective view of the fluid mixing element in this embodiment.

A fluid mixing element 10 in accordance with this embodiment is, as shown in FIG. 1, applied to a pipe structure 20 that is arranged to connect a sub-flow channel (B) with a main flow channel (A) midstream and promotes mixing of a first fluid flowing in the main flow channel (A) and a second fluid flowing in the sub-flow channel (B). The first fluid and the second fluid are gasses of different types used for, for example, semiconductor processes, and a flow rate of the first fluid is set higher than that of the second fluid. In addition, each of the fluids is not limited to a fluid composed of a single component, and could include a mixture of a plurality of precursory gasses.

First, the pipe structure 20 will be explained. The pipe structure 20 in this embodiment comprises a tubular pipe 20*a* constituting the main flow channel (A) integrally connected to a tubular pipe 20*b* constituting the sub-flow channel (B). For example, an existing T-shaped joint is utilized as it is as the pipe structure 20. Concretely, the main flow channel (A) is linear and the sub-flow channel (B) crosses generally at right angles in the middle of the main flow channel (A) and a terminal end (B1) of the sub-flow channel (B) opens on an inner wall of the main flow channel (A). The pipe structure may comprise the main flow channel and the sub-flow channel formed by perforating a block body.

Next, the fluid mixing element 10 will be explained. The fluid mixing element 10 is, as shown in FIG. 2-FIG. 5, generally columnar, and a circumferential groove 41 is arranged on a side peripheral surface of a middle part 12 so that a maximum diameter portion is formed on one end part 11 located in front of the middle part 12 and a maximum diameter portion is formed on the other end part 13 located to the rear of the middle part 12. An outer diameter of the one end part 11 and an outer diameter of the other end part 13 are set to be generally equal to an inner diameter of the main flow channel (A) so as to make it possible to insert the fluid mixing element 10 into the main flow channel (A) with a sliding movement generally without any gap.

In this embodiment, as shown in FIG. 1, the fluid mixing element 10 is so arranged that the above-mentioned one end part 11 fits into the main flow channel (A) at an upstream side of the terminal end opening (B1) of the sub-flow channel (B), namely, at an upstream side of a portion where the main flow channel (A) is connected with the sub-flow channel (B), and the above-mentioned other end part 13 fits into the main flow channel (A) at a downstream side of the terminal end opening (B1) of the sub-flow channel (B) so that the circumferential groove 41 is arranged to face the terminal end opening (B1) of the sub-flow channel (B).

As shown in FIG. 2-FIG. 5, the fluid mixing element 10 is further provided with two kinds of internal flow channels, namely a first internal flow channel 3 and a second internal flow channel 4.

Figure 3:
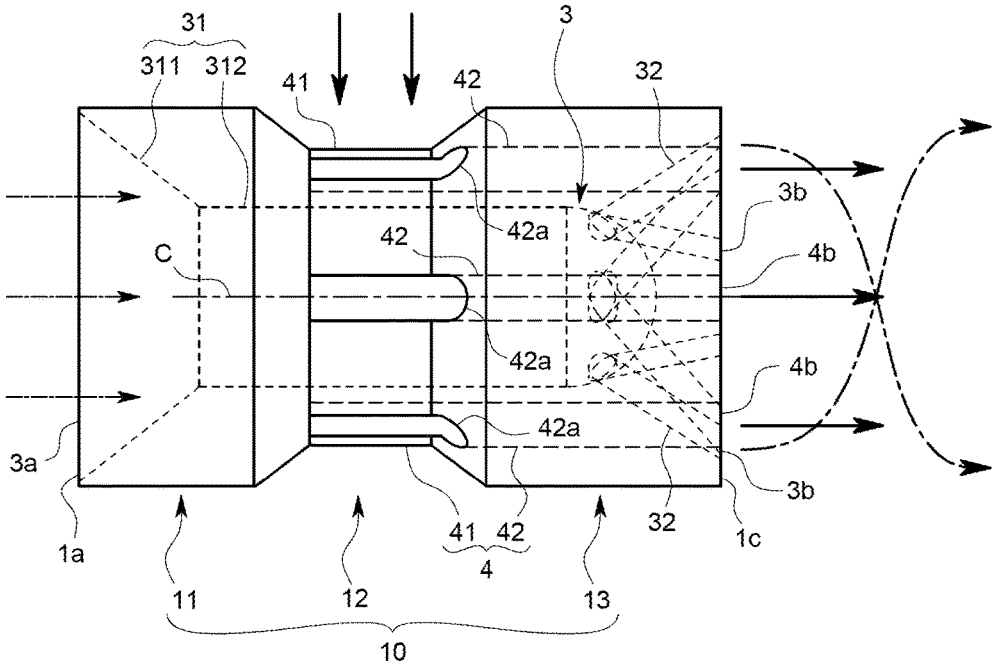
FIG. 3 is a side view of the fluid mixing element in this embodiment.
Figure 4:
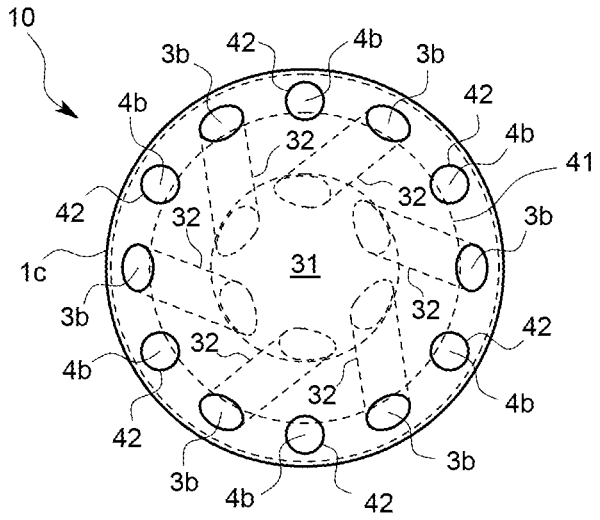
FIG. 4 is an end surface view of the other end part of the fluid mixing element in this embodiment.
Figure 5:
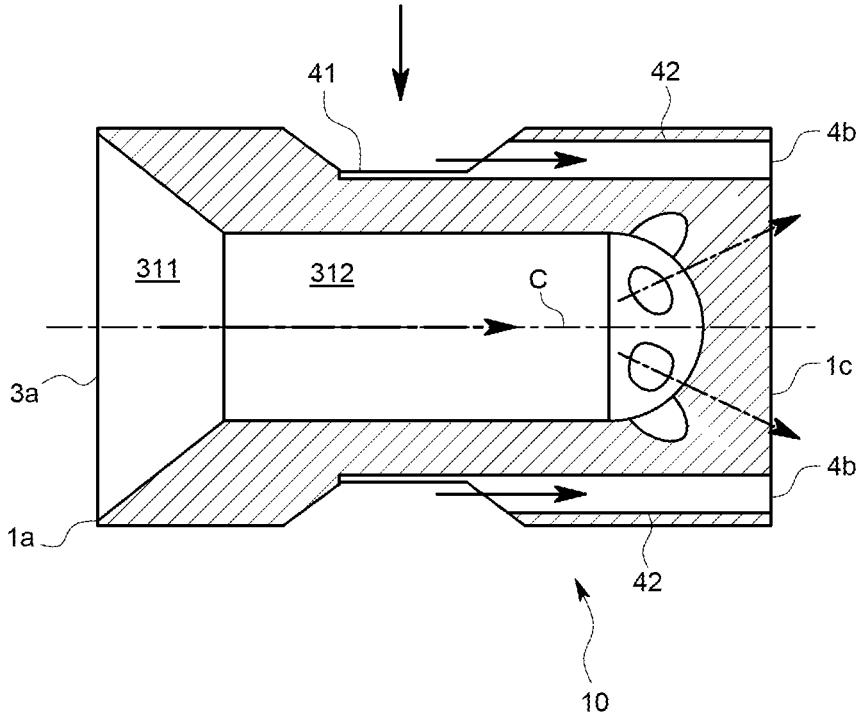
FIG. 5 is a longitudinal sectional view of the fluid mixing element in this embodiment.
Figure 6:
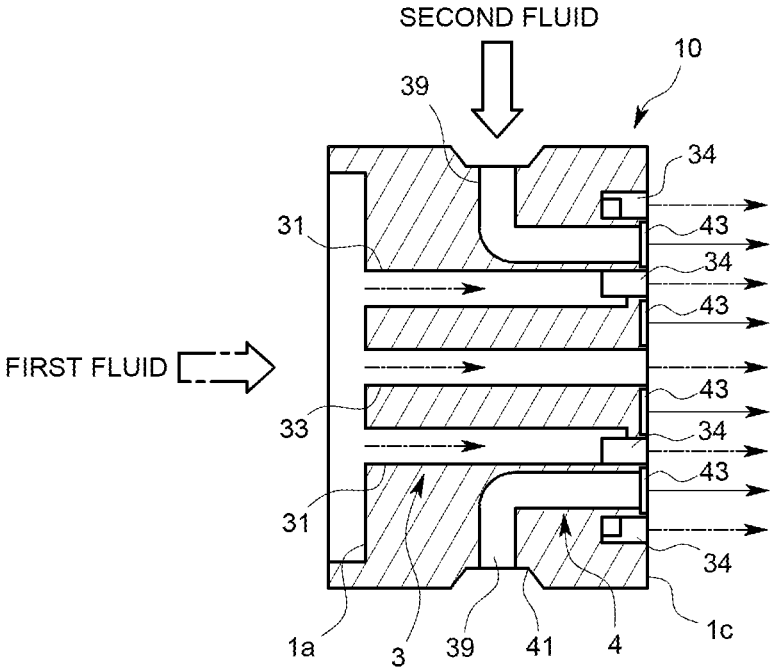
FIG. 6 is a longitudinal sectional view of a fluid mixing element in accordance with a second embodiment of this invention.
Figure 7:
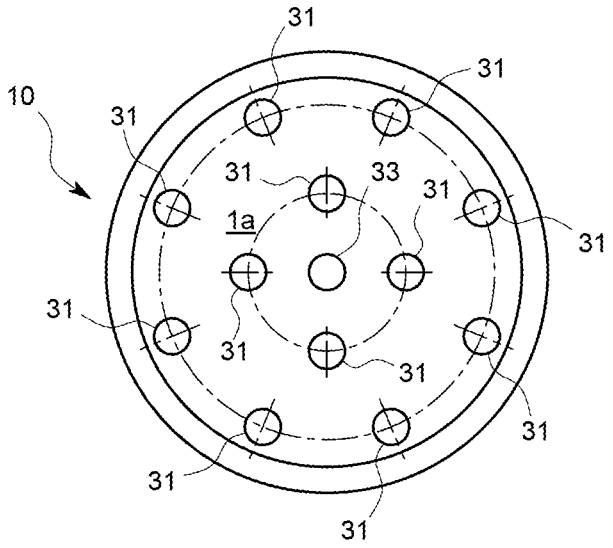
FIG. 7 is an end surface view of one end part of the fluid mixing element in accordance with this embodiment.
Figure 8:
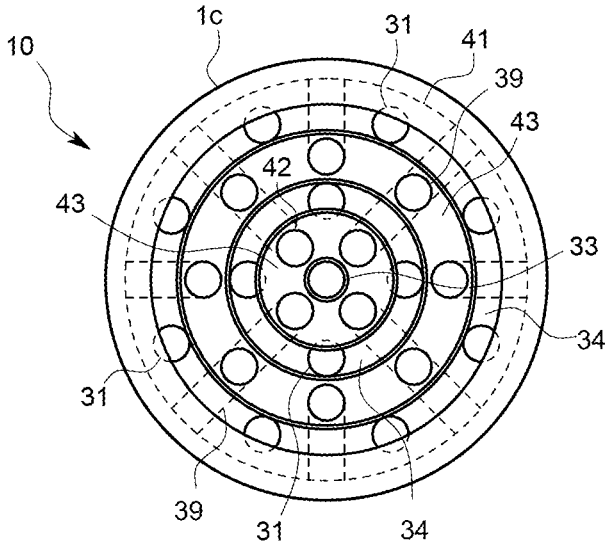
FIG. 8 is an end surface of the other end part of the fluid mixing element in this embodiment.
Figure 9:
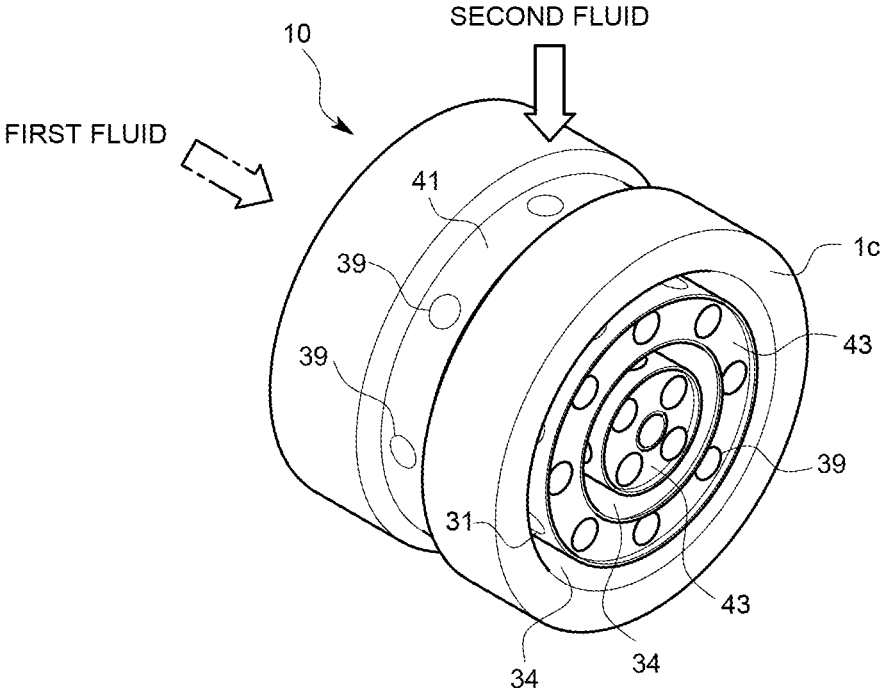
FIG. 9 is a perspective view of the fluid mixing element in accordance with this embodiment.

As shown in FIG. 3 - FIG. 5, the first internal flow channel 3 is arranged such that a starting end 3*a* of the first internal flow channel 3 opens on an end surface 1*a* of the above-mentioned one end part 11 and a terminal end 3*b* of the first internal flow channel 3 opens on an end surface 1*c* of the other end part 13. All of the first fluid that flows from the main flow channel (A) upstream of the fluid mixing element 10 passes through the first internal flow channel 3 and then is discharged to the main flow channel (A) located on a downstream side of the fluid mixing element 10.

More concretely, the first internal flow channel 3 comprises a front flow channel 31 with the starting end 3*a* that opens on the one end surface 1*a* of the fluid mixing element 10 and that extends along a center axial line (C) and a plurality of back flow channels 32 that diverge from a terminal end of the front flow channel 31 and whose diameter is generally uniform. The front flow channel 31 comprises a conical portion 311 with an internal diameter that gradually decreases from the circular starting end opening 3*a* that extends generally throughout all of the one end surface 1*a* and a constant diameter portion 312 that extends from the conical portion 311. In addition, each of the back flow channels 32 extends toward a diagonal outside while twisting and each of the terminal ends 3*b* opens, as shown in FIG. 5, on an outer peripheral edge part of the end surface 1*c* of the other end part 13 in a circumferential direction at even internals.

The second internal flow channel 4 comprises, as shown in FIG. 3 or the like, the above-mentioned circumferential groove 41 and a plurality of through bores 42 which communicate with the circumferential groove 41. The through bore 42 has a generally constant diameter and extends in parallel to the center axial line (C) of the fluid mixing element 10 A number of through bores 42 is the same as that of the back flow channels 32. A starting end 42*a* of each through bore 42 opens on a bottom side surface of the circumferential groove 41 and a terminal end 4*b* opens on the outer peripheral edge of the end surface 1*c* of the other end part 13. In addition, each of the terminal ends 4*b* is arranged, as shown in FIG. 4, at even intervals, alternatingly on the same circumference with the terminal end openings 3*b* of each back flow channel 32.

Next, an action by the fluid mixing element 10 having the above-mentioned arrangement will be explained.

All of the first fluid that flows from the upstream side of the main flow channel (A) passes through the first internal flow channel 3 of the fluid mixing element 10. At this time, a speed of the first fluid increases when the first fluid passes through a portion where a cross-sectional area of the flow channel decreases, namely the conical portion 311 of the front flow channel 31. Later, when the first fluid diverges and passes through each of the back flow channels 32, a vector component in the circumferential direction is added to the flow vector so that the first fluid twists while jetting out from the end surface 1*c* of the other end part 13 of the fluid mixing element 10 to the downstream side of the main flow channel (A).

Meanwhile, all of the second fluid that flows from the upstream side of the sub-flow channel (B) passes through the second internal flow channel 4 of the fluid mixing element 10. At this time, when the second fluid that enters from a direction orthogonal to an axial direction (an extending direction) of the main flow channel (A) passes through the circumferential grooves 41 and then diverges into the through bores 42, the flow vector of the second fluid becomes in parallel to the extending direction of the main flow channel (A) and then the second fluid flows out in parallel to the main flow channel (A) from the end surface 1*c* of the other end part 13 of the fluid mixing element 10.

As mentioned above, since the terminal end openings 3*b* of the first internal flow channel 3 and the terminal end openings 4*b* of the second internal flow channel 4 are arranged in turn on the same circumference on the end surface 1*c* of the other end part 13 of the fluid mixing element 10, the second fluid, regardless of the flow rate, flowing out in parallel to the main flow channel (A) from the terminal end openings 4*b* of the second internal flow channel 4, is convolved with the first fluid that has the component in the circumferential direction and the component in the radial direction and that flows out from the terminal end openings 3*b* while twisting, and then the second fluid is compulsorily and instantly mixed with the first fluid.

In addition, since a traveling vector of the first fluid just after leaving the fluid mixing element 10 contains the component in the radial direction, the flow near the center of the main flow channel (A) and the flow near the inner side surface mix with each other, thereby further promoting mixing of each fluid.

As mentioned, in accordance with this embodiment, it is possible to achieve mixing of the fluids in a short period of time by the use of a short pipe.

In addition, since both the first fluid and the second fluid flow out from the end surface 1*c* of the other end part 13 of the fluid mixing element 10, the first fluid neither enters the sub-flow channel (B) nor interferes with the second fluid entering into the main flow channel (A).

Furthermore, since the fluid mixing element 10 is columnar with the same diameter as that of the main flow channel (A), it is possible to install the fluid mixing element 10 with ease just by sliding the fluid mixing element 10 into the main flow channel (A) so that there is no need for welding or special processing. Especially in this embodiment, since an inlet of the second internal flow channel 4 is the circumferential groove 41 that goes around the fluid mixing element 10, the second internal flow channel 4 is connected to the terminal end opening (B1) of the sub-flow channel (B) just by inserting the fluid mixing element 10 into the main flow channel (A) without adjusting the angle of the axial center and positioning the fluid mixing element 10 so that it becomes very easy to install the fluid mixing element 10.

Second Embodiment

Next, a second embodiment of this invention will be explained with reference to FIG. 6~FIG. 9.

A fluid mixing element 10 of this embodiment is similar to the fluid mixing element 10 of the first embodiment, however, it is different from that of the first embodiment in that a shape of the fluid mixing element 10 of this embodiment is a little flat and a structure of the internal flow channel is different.

The internal flow channel that is the difference will now be explained in detail.

A first internal flow channel 3 comprises a plurality of front flow channels 31 whose starting end opens on an end surface 1*a* of one end part of the fluid mixing element 10 and each of which extends in parallel to a center axial line of the fluid mixing element 10, and multiple layers of first circular grooves 34 arranged on an end surface 1*c* the other end part of the fluid mixing element 10. Each of the front flow channels 31 is arranged at even intervals on each of the first circular grooves 34 viewed from the axial line direction, and a terminal end of each front flow channel 31 opens on a bottom surface (and a side surface) of each of the first circular grooves 34. A single through channel 33 is arranged on a center axial line (C) and the through channel 33 also constitutes the first internal flow channel 3.

A second internal flow channel 4 comprises a circumferential groove 41 arranged on a side peripheral surface of a middle part of the fluid mixing element 10 similar to that of the first embodiment, a plurality of middle flow channels 39, each of which extends from a bottom surface of the circumferential groove 41 to a radial direction and then bends and extends in parallel to the axial line direction, and multiple layers of second circular grooves 43 arranged on the end surface 1*c* of the other end part of the fluid mixing element 10. The middle flow channels 39 are arranged at even intervals in a circumferential direction viewed from the axial line direction, and a terminal end of each of the middle flow channels 39 opens on a bottom surface of one of the second circular grooves 43 and communicates with the second circular groove 43. The second circular grooves 43 are arranged in turn with the first circular grooves 34 and a depth of the second circular grooves 43 is shallower than that of the first circular grooves 34.

In accordance with this arrangement, even though it cannot be expected that mixing is promoted due to a twist similar to the fluid mixing element 10 of the first embodiment, the same operation and effect as that of the first embodiment can be produced except for the mixing operation and effect. In addition, unlike the fluid mixing element 10 of the first embodiment, since there is no need to provide an oblique bore for the fluid mixing element 10 of this embodiment, it becomes easy to manufacture the fluid mixing element 10.

Other Embodiments

The present claimed invention is not limited to the above-mentioned embodiments.

Figure 10:
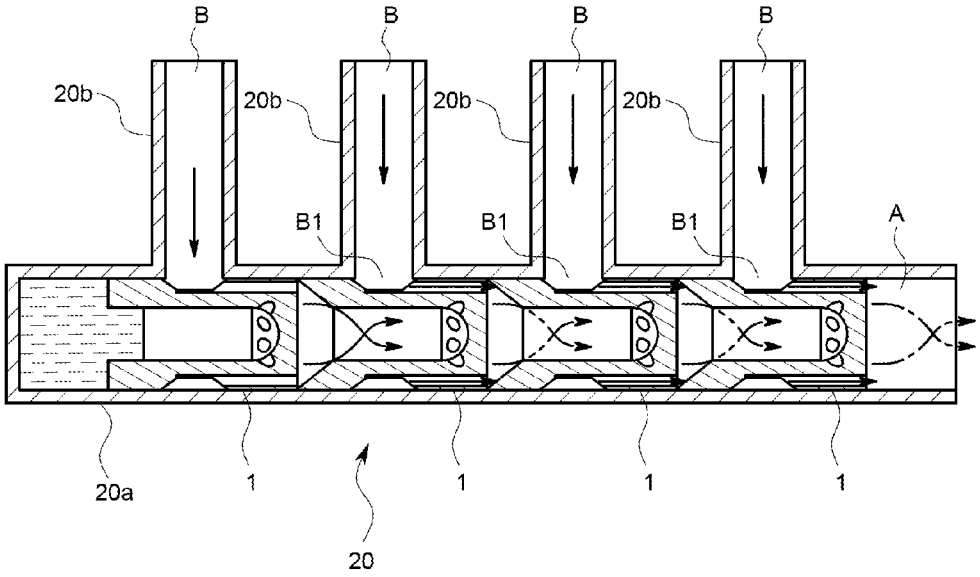
FIG. 10 is a longitudinal cross-sectional view showing a pipe structure and a fluid mixing element in accordance with another embodiment of this invention.

For example, as shown in FIG. 10, the pipe structure 20 may have an arrangement such that a plurality of sub-flow channels (B) are arranged on the main flow channel (A) at the upstream side. In FIG. 10, the fluid mixing element 10 of the first embodiment is arranged at a portion where the main flow channel (A) is connected to the sub-flow channel (B) respectively and the adjacent fluid mixing elements 10 generally contact each other.

Figure 11:
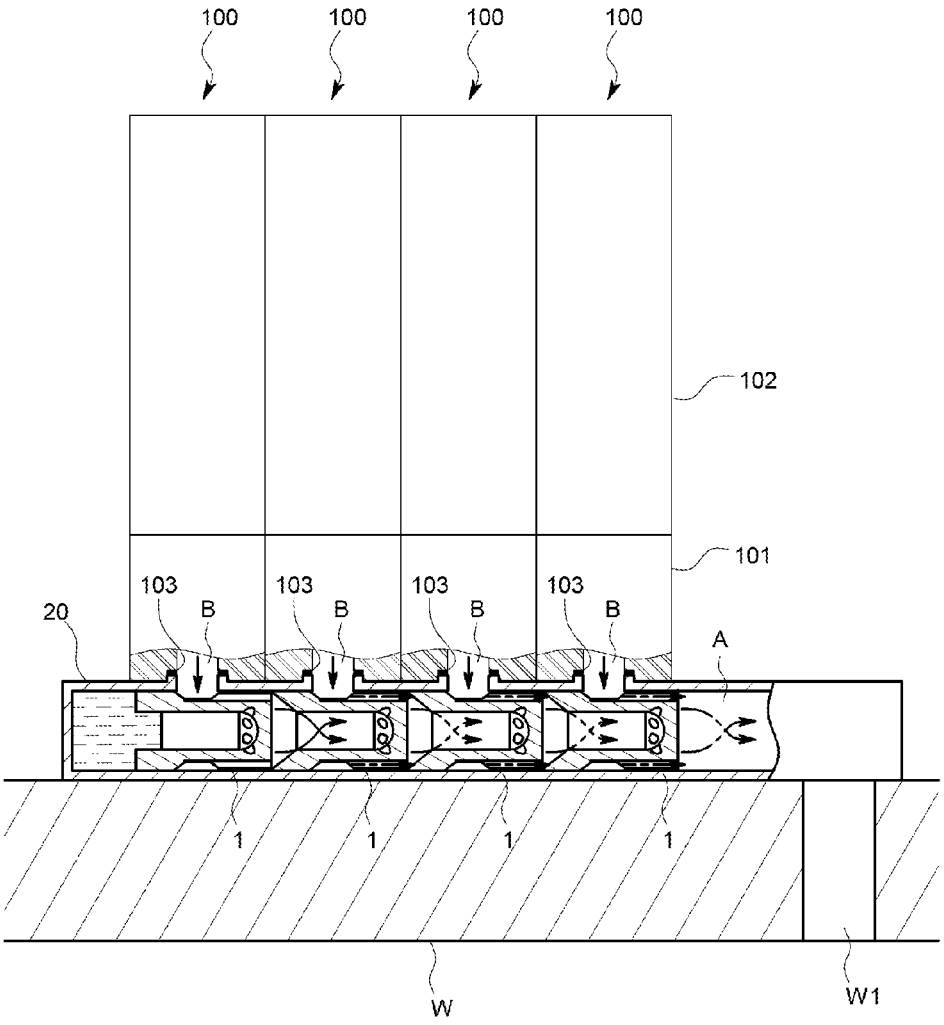
FIG. 11 is a side view showing a state wherein a fluid mixing element is mounted on a pipe structure in accordance with a further different embodiment of this invention.
Figure 12:
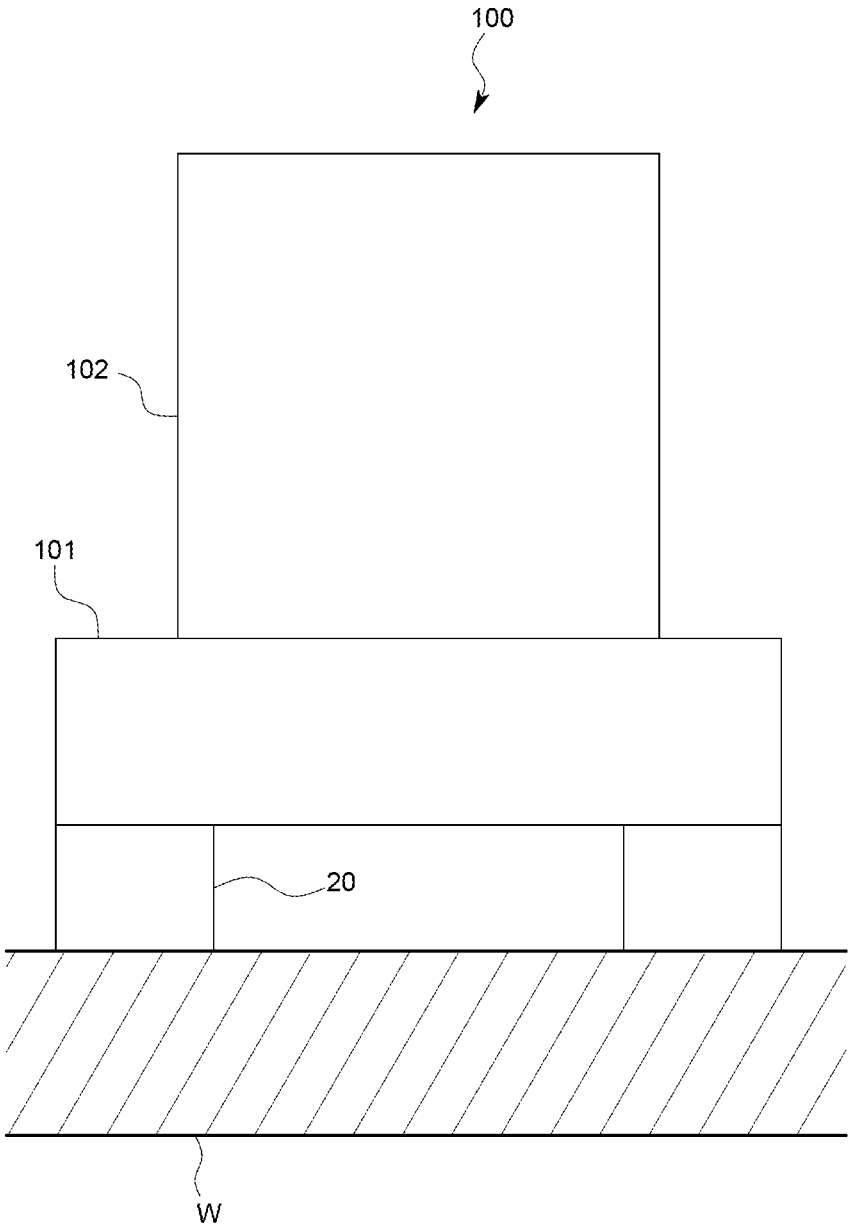
FIG. 12 is a front view showing a state wherein the fluid mixing element is mounted on the pipe structure in accordance with this embodiment.

A practical example of using the pipe structure 20 and the fluid mixing element 10 is shown in FIG. 11 and FIG. 12. In this practical example, a plurality of mass flow controllers 100 are arranged practically without any space and the pipe structure 20 is connected to a bottom surface of the mass flow controllers 100.

More specifically, the mass flow controllers 100 comprise a body block 101 inside of which an internal flow channel and a fluid resistance element (not shown in drawings) are formed, and a casing part 102 that houses a pressure sensor arranged on an upper surface of the body block 101 and a valve (not shown in drawings). The mass flow controllers 100 are an elongated rectangle when viewed from above (a plan view). An introducing port (not shown in drawings) for a fluid is arranged on one end part of a bottom surface of the body block 101. A discharging port 103 for the fluid is arranged on the other end part thereof.

The plurality of mass flow controllers 100 are arranged in a state in which outer surfaces that are parallel in a longitudinal direction are practically and tightly attached to each other and the discharging port 103 of each mass flow controller 100 is connected to the pipe structure 20.

In accordance with this arrangement, as shown in FIG. 11 and FIG. 12, since it is possible to directly load the pipe structure 20 that is loaded with the plurality of mass flow controllers 100 on an outer wall (for example, a cap part of an upper wall) (W) of a semiconductor process chamber and to connect the main flow channel (A) of the pipe structure 20 with a flow channel (W1) for supplying a precursory gas into the inside by penetrating the outer wall (W), it is possible to achieve drastic downsizing compared with a conventional arrangement wherein mass flow controllers are separately arranged throughout pipes. In addition, since a distance between the mass flow controllers 100 and the flow channel (W1) can be drastically shortened, it is possible to improve response of controlling a flow rate of a fluid. Furthermore, if the pipe structure is mounted on the cap part of the chamber, since the cap part (W) is dismounted when maintaining the chamber, it is preferable because maintenance can be conducted at the same time when the chamber is maintained.

Figure 13:
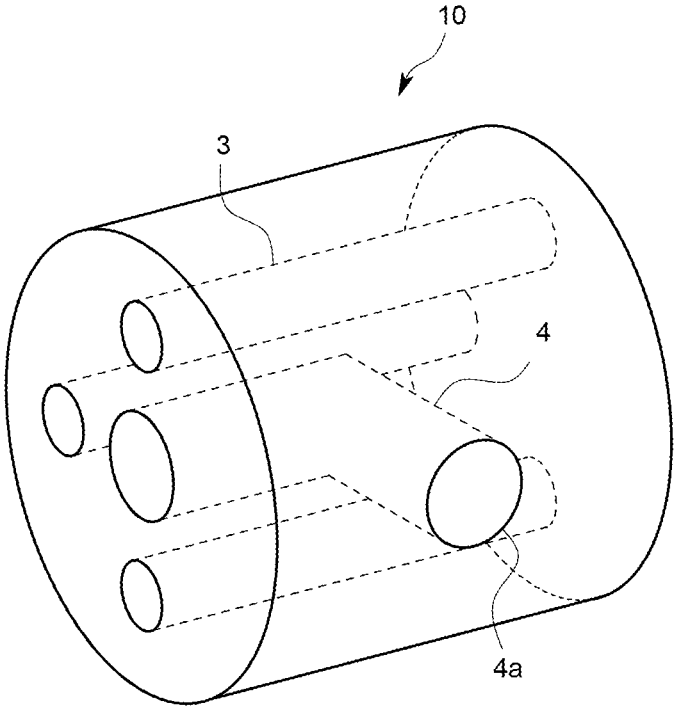
FIG. 13 is a perspective view of a fluid mixing element in accordance with a further different embodiment of this invention.

In addition, for example, as shown in FIG. 13, it may be so configured that an outer diameter of the fluid mixing element 10 is made constant without providing a circumferential groove on a side peripheral surface of a middle part. In this case, since a starting end opening 4*a* of the second internal flow channel 4 is exposed to a part of the side peripheral surface of the middle part, it is necessary to adjust an angle of the fluid mixing element 10 so as to coincide the starting end opening 4*a* with the terminal end opening of the sub-flow channel.

Figure 14:
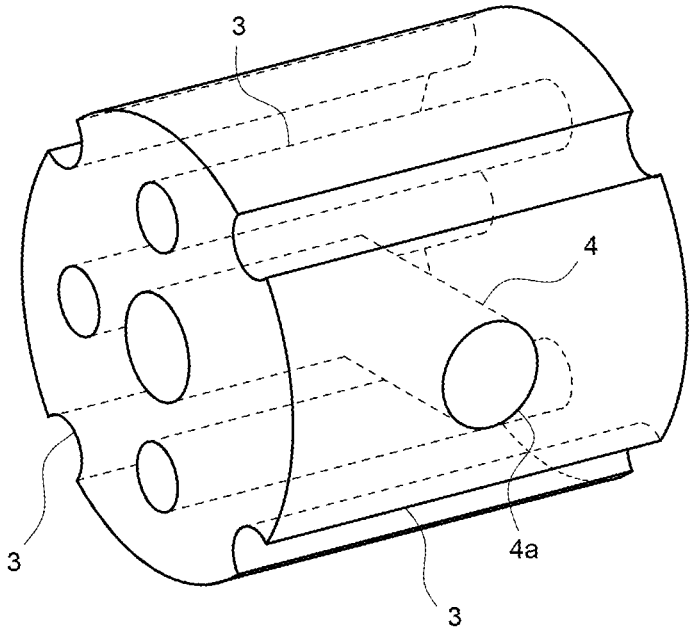
FIG. 14 is a perspective view of a fluid mixing element in accordance with a further different embodiment of this invention.

In addition, as shown in FIG. 14, a longitudinal groove that extends in the axial direction may be provided on the side peripheral surface of the fluid mixing element 10 and the longitudinal groove may serve as the first internal flow channel 3. In this case also, the fluid mixing element 10 fits into the main flow channel (A) snugly.

In addition, a further different agitating element may be arranged downstream of the fluid mixing element in the main flow channel.

Furthermore, each of a number of the first internal flow channel and a number of the second internal flow channel may be one respectively.

Figure 15:
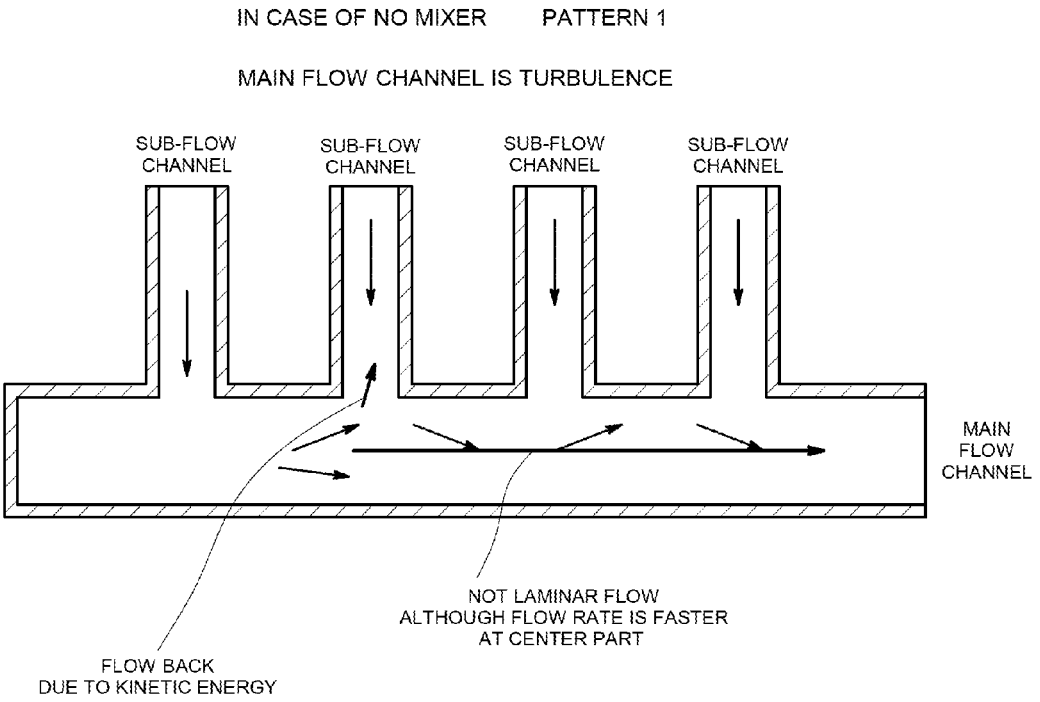
FIG. 15 is a perspective view of a fluid mixing element in accordance with a further different embodiment of this invention.
Figure 16:
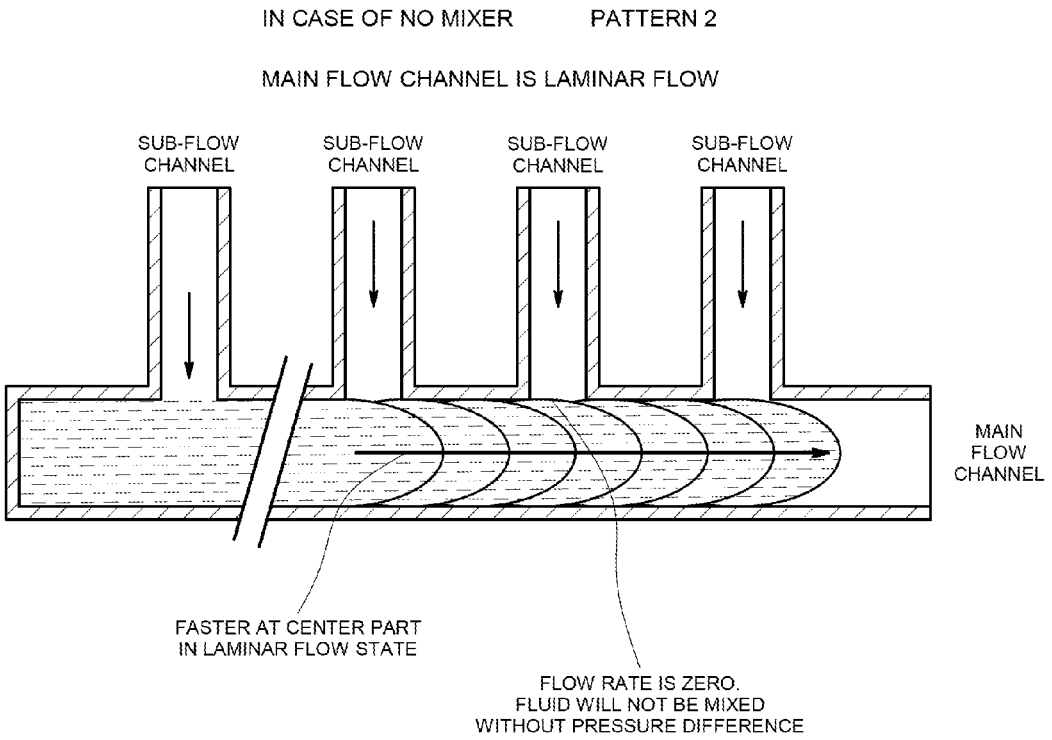
FIG. 16 is a perspective view of a fluid mixing element in accordance with a further different embodiment of this invention.

In addition, the sub-flow channel does not necessarily cross the main flow channel at right angles, and may cross obliquely. In this case, there is no limitation for the angle of the sub-flow channel. For a conventional arrangement as shown in FIG. 15 and FIG. 16, in a case of mounting the sub-flow channel obliquely, it is necessary to incline the sub-flow channel so as to approach the main flow channel from an upstream side of the main flow channel (in a reverse case, the first fluid of the main flow channel is at high risk of entering the sub-flow channel); however, in accordance with this invention, there is no such risk and as mentioned above, since there is no limitation for the angle of the sub-flow channel, it is also possible to obtain an effect that there is a lot of flexibility for the pipe.

EXPLANATION OF REFERENCE CHARACTERS

10 . . . fluid mixing element
20 . . . pipe structure (pipe member)
11 . . . one end part
12 . . . middle part
13 . . . other end part
1*a* . . . end surface of one end part

1*c* . . . end surface of other end part
3 . . . first internal flow channel
4 . . . second internal flow channel
A . . . main flow channel
B . . . sub-flow channel

The invention claimed is:

1. A fluid mixing element that is arranged in a pipe member where a sub-flow channel where a second fluid flows is connected to a main flow channel where a first fluid flows so as to mix the first fluid and the second fluid, the volume of the first fluid being larger than the volume of the second fluid, wherein a first internal flow channel comprises a front flow channel whose starting end opens on an end surface of one end part of the fluid mixing element and a plurality of back flow channels whose starting ends diverge from a terminal end of the front flow channel and whose terminal ends open on an end surface of another end part of the fluid mixing element, a second internal flow channel comprises a circumferential groove arranged on a side peripheral surface of a middle part between the one end part and the other end part, and through bores that extend along the center axial line of the fluid mixing element whose starting ends open on a bottom surface of the circumferential groove and whose terminal ends open in the end surface of the other end part, a diameter of the middle part is smaller than a diameter of the one end part and a diameter of the other end part, the above-mentioned one end part fits into the main flow channel at an upstream side of a portion where the main flow channel is connected with the sub-flow channel and the above-mentioned other end part fits into the main flow channel at a downstream side of the portion where the main flow channel is connected with the sub-flow channel so that a terminal end opening of the sub-flow channel is arranged to face a starting end opening of the second internal flow channel, flow directions of the back flow channels extend diagonally away from a center axial line of the first internal flow channel, and from an end surface view, the terminal ends of the plurality of back flow channels are positioned farther from the center axial line than the starting ends of the plurality of back flow channels are positioned from the center axial line.

2. The fluid mixing element described in claim 1, wherein a plurality of terminal end parts of the second internal flow channel are arranged.

3. The fluid mixing element described in claim 1, wherein a plurality of terminal end parts of the first internal flow channel and a plurality of terminal end parts of the second internal flow channel are arranged, and openings of the plurality of terminal end parts of the first internal flow channel and openings of the plurality of terminal end parts of the second internal flow channel are alternately arranged on the end surface of the other end part of the fluid mixing element.

* * * * *